US007866956B2

(12) United States Patent
Lin et al.

(10) Patent No.: US 7,866,956 B2
(45) Date of Patent: Jan. 11, 2011

(54) OIL PUMP FOR MOTORCYCLE

(75) Inventors: Ching-Huei Lin, Kaohsiung (TW); Chao-Chang Ho, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 982 days.

(21) Appl. No.: 11/421,767

(22) Filed: Jun. 2, 2006

(65) Prior Publication Data

US 2007/0277751 A1 Dec. 6, 2007

(51) Int. Cl.
*F04B 35/00* (2006.01)

(52) U.S. Cl. ..... 417/362; 417/360; 123/198 C

(58) Field of Classification Search ..... 417/362, 417/360, 364; 123/41.44, 196, 195 A, 195 R, 123/196 R, 90.39, 54.4, 198 C; 184/6.5
See application file for complete search history.

(56) References Cited

U.S. PATENT DOCUMENTS 6,047,667 A * 4/2000 Leppanen et al. ..... 123/196 R
6,595,178 B2 * 7/2003 Araki ..... 123/195 R
6,618,887 B2 * 9/2003 Kim et al. ..... 8/158
7,188,601 B1 * 3/2007 Trease ..... 123/198 C
2004/0231626 A1 * 11/2004 Trease ..... 123/90.39

* cited by examiner

*Primary Examiner*—Charles G Freay
*Assistant Examiner*—Todd D Jacobs
(74) *Attorney, Agent, or Firm*—Leong C. Lei

(57) ABSTRACT

An oil pump system is provided for a motorcycle, and includes at least one oil pump, a water pump, a drive shaft, a support frame, a drive gear, and an oil collector lid. The oil pump is supported by a crankshaft case and is coupled to the drive shaft. The drive shaft has an end section on which the drive gear is mounted. The drive gear is coupled to a crankshaft of an engine by a chain. The oil collector lid is arranged outside the drive gear. The water pump is coupled to the end of the drive shaft. Mechanical power is transmitted from the crankshaft, through the chain, to drive the drive gear and the drive shaft to also drive the water pump. The support frame is provided to rotatably support the drive shaft at a location spaced from the oil pump so as to form an enhanced support to the drive shaft and improve stability of operation and durability of the drive shaft.

1 Claim, 4 Drawing Sheets

OIL PUMP FOR MOTORCYCLE

BACKGROUND OF THE INVENTION (a) Technical Field of the Invention

The present invention relates to an oil pump for a motorcycle, and in particular to a motorcycle oil pump that provides stable pumping of oil and enhanced durability.

(b) Description of the Prior Art

A motorcycle engine is provided with a lubrication system to ensure proper operation the engine. FIG. 1 of the attached drawings shows a conventional motorcycle engine lubrication system, which generally comprises an oil pan 10, an oil pump 11, and an oil passage 12. The oil pump 11 continuously draws and drives oil (which is a lubricant) contained in the oil pan 10 through the oil passage 12 to a variety of locations inside an engine E, such as rocker arm E3, crankshaft 2, piston E1, and internal wall of cylinder E2, for lubricating the engine E. The oil will eventually returns to the oil pan 10. The circulation is cycled to continuously lubricate the engine E.

Also referring to FIG. 2, the oil pump 11 is fixed to a crankshaft case 3 by threaded fasteners S to ensure stable positioning of the oil pump 11 and stable pumping of the lubricant. The oil pump 11 has a drive shaft 112 on which a drive gear 113 is mounted. An oil collector lid 114 is arranged at an end of the drive shaft 112, which is also fixed to the crankshaft case 3 by the fasteners S. The oil collector lid 114 is configured as an outward expanded pan-like member, functioning to preserve a certain amount of oil therein. When the engine E is inclined, the residual amount of oil inside the oil collector lid 114 can provide the drive gear 113 and the drive chain 22 with acceptable lubrication to maintain proper operation and minimize wearing thereof. Mounted outside the oil collector lid 114 a water pump 111 for driving cooling water. The water pump 111 has a shaft 1111 that is coaxially coupled to and thus rotatable in unison with the drive shaft 112. Thus, the water pump 111 is operatively coupled to the oil pump 11.

The oil pump 11 is driven by the drive chain 22. An end of the drive chain 22 is coupled to a transmission gear 21 of the crankshaft 2 and an opposite and coupled to the drive gear 113. When engine E is in operation, the chain 22 is driven by the crankshaft 2 to rotate the drive shaft 112, which in turns drives the oil pump 11. The oil pump 11 thus continuously pump the oil through the oil passages 12 for circulating the oil through the engine E, such as the rocker arms E3, the crankshaft 2, the pistons E1, and the internal walls of the engine cylinders E2, to lubricate the engine E.

Although the above described conventional oil pump 11 is effective in driving oil through and thus fully lubricating the engine E. However, the drive shaft 112 is basically supported by the oil pump 11 that physically engages an end portion of the shaft 112, which leaves an opposite end of the drive shaft 112 unsupported and forming a cantilevered construction. Although the cantilevered end of the shaft 112 is in contact with the shaft 1111 of the water pump 111, the shaft 1111 of the water pump 111 is itself of a cantilever arrangement. Since the load of the engine E is not fixes during the operation of the engine E, the rotational speed of the engine E is not fixed either, which often leads to oscillation of the drive shaft 112 due to abrupt change of rotational speed of the engine E, and vibration is included on the drive chain 22 by the oscillation of the drive shaft 112. Thus, enlarged gap between parts and noise caused thereby are generated. Further, the drive shaft 112 may be damaged by long-lasting vibration, leading to shortened service life.

It is thus desired to provide an oil pump that overcomes the above discussed drawbacks.

SUMMARY OF THE INVENTION

The primary purpose of the present invention is to provide an oil pump system, comprising at least one oil pump, a water pump, a drive shaft, a support frame, a drive gear, and an oil collector lid. The oil pump is supported by a crankshaft case and is coupled to the drive shaft. The drive shaft has an end section on which the drive gear is mounted. The drive gear is coupled to a crankshaft of an engine by a chain. The oil collector lid is arranged outside the drive gear. The water pump is coupled to the end of the drive shaft. Mechanical power is transmitted from the crankshaft, through the chain, to drive the drive gear and the drive shaft to also drive the water pump. The support frame is provided to rotatably support the drive shaft at a location spaced from the oil pump so as to form an enhanced support to the drive shaft and improve stability of operation and durability of the drive shaft.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference number refer to identical or similar parts.

Many other advantages and features of the present invention will become manifest to those versed in the art upon making reference to the detailed description and the accompanying sheets of drawings in which a preferred structural embodiment incorporating the principles of the invention is shown by way of illustrative example.

BRIEF DESCRIPTION OF THE DRAWINGS

The present invention will be apparent to those skilled in the art by reading the following description of preferred embodiment of the invention, with reference to the attached drawings, in which.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
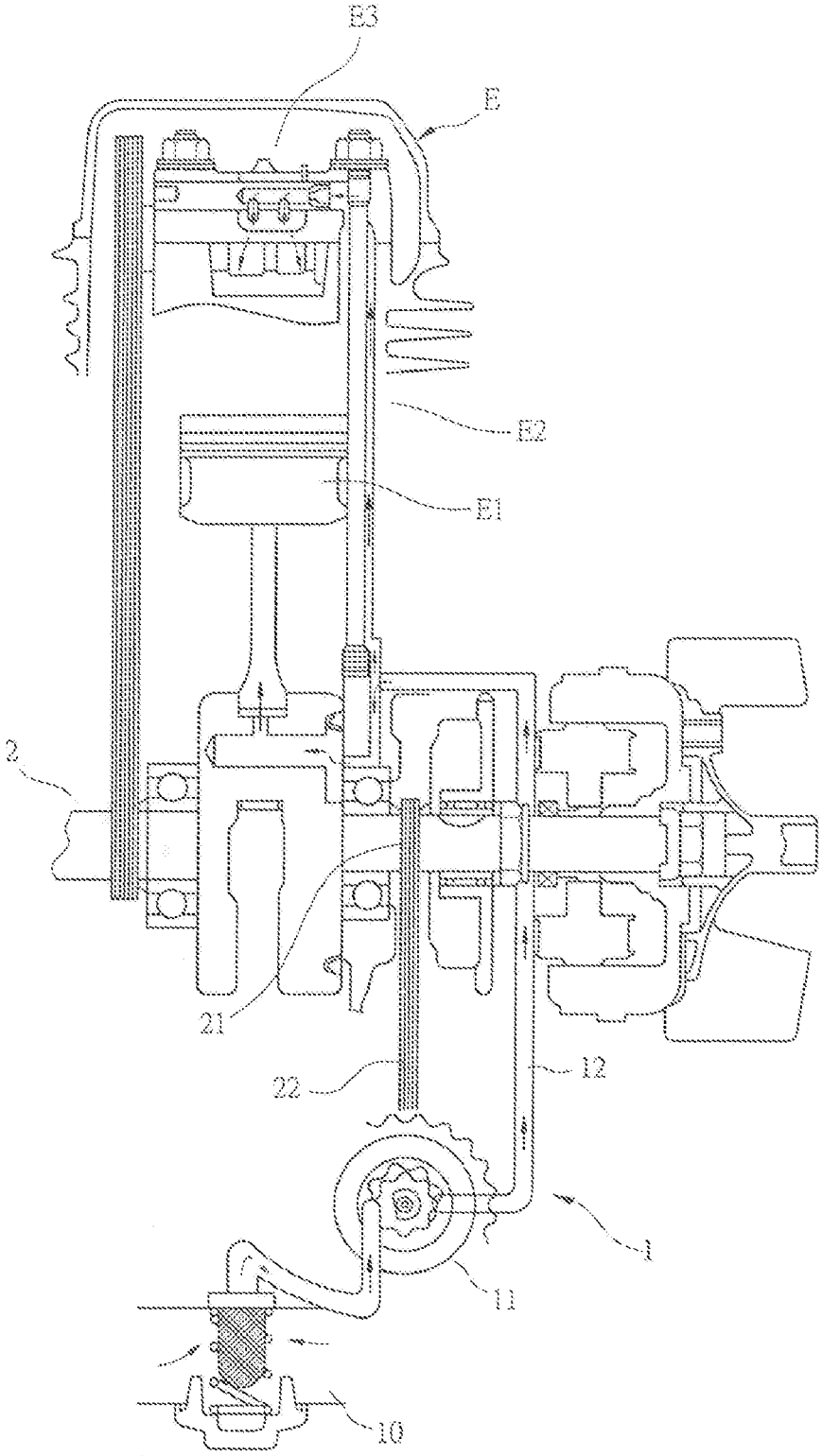
FIG. 1 PRIOR ART
FIG. 1 is a schematic view of a conventional engine lubrication system comprising an oil pump.
Figure 2:
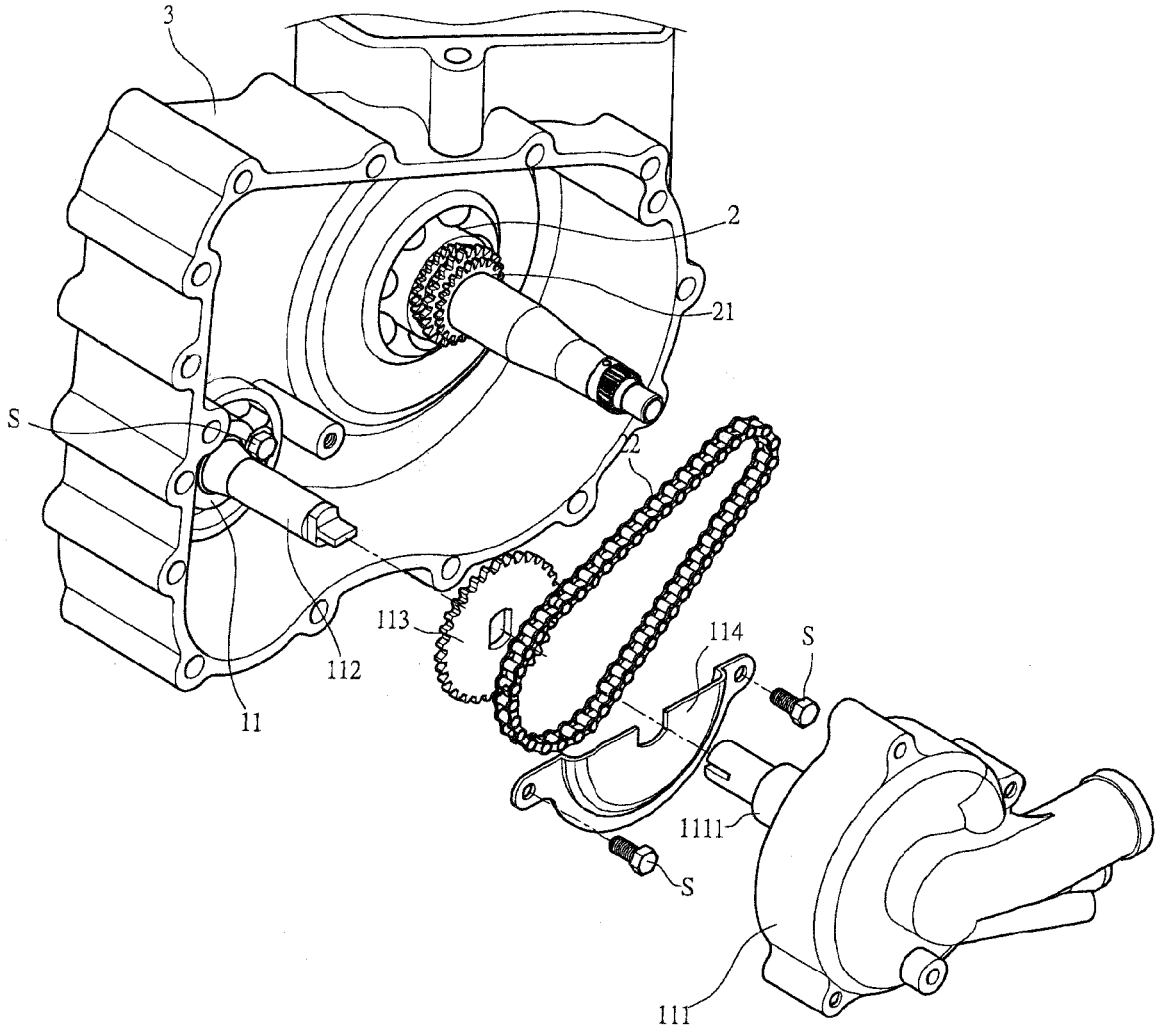
FIG.2 PRIOR ART
FIG. 2 is an exploded view of the conventional oil pump.
Figure 3:
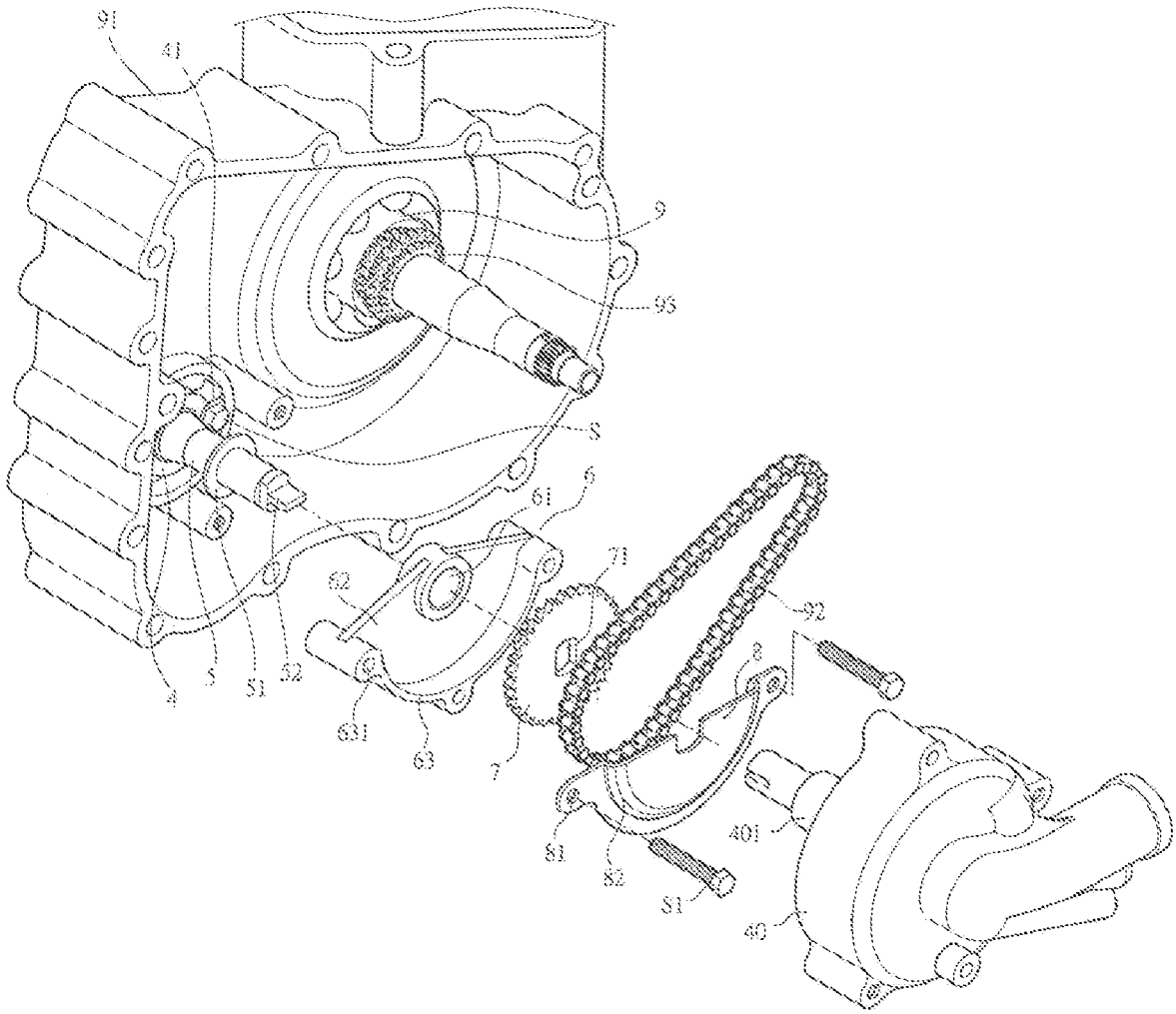
FIG. 3 is an exploded view of an oil pump system in accordance with the present invention.
Figure 4:
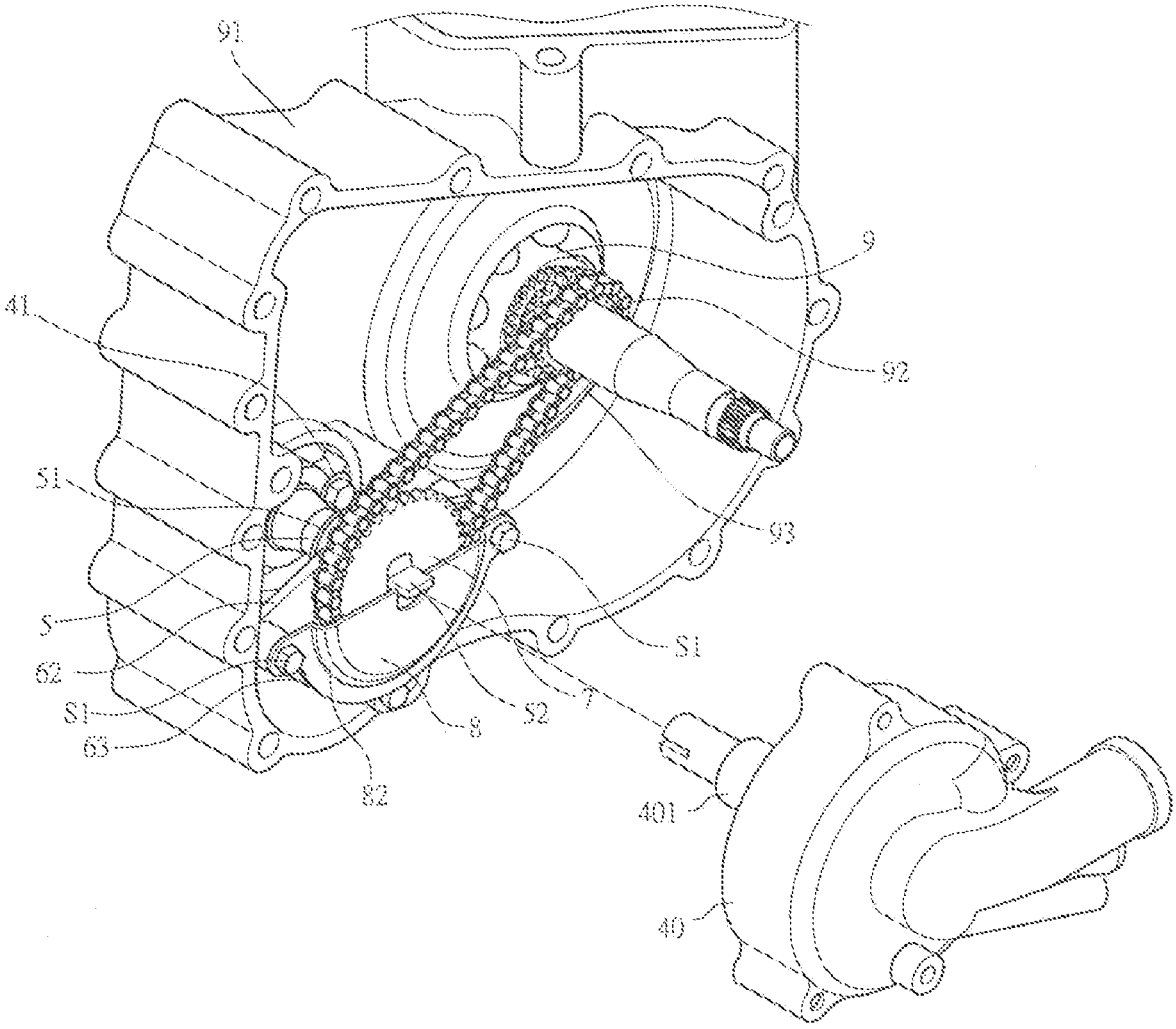
FIG. 4 is a partially assembled view of the oil pump system of the present invention.

With reference to the drawings and in particular to FIGS. 3 and 4, an oil pump system constructed in accordance with the present invention comprises an oil pump 4, a water pump 40, a drive shaft 5, a support frame 6, a drive gear 7, and an oil collector lid 8.

The oil pump 4 is fixed to a crankshaft case 91 and is rotatably supported for continuous rotation to pump oil. The oil pump 4 defines securing holes 41 that receive threaded fasteners S1 to secure the oil pump 4 to the crankshaft case 91 thereby making the oil pump 4 stably positioned. The oil pump 4 is coupled to the drive shaft 5 for being driven by the drive shaft 5 for pumping operation.

The drive shaft 5 has an opposite end extending in a direction away from the oil pump 4. A stop ring 51, the support frame 6, the drive gear 7, and the oil collector lid 8, are mounted, in sequence, to the opposite end section of the drive shaft 5. The stop ring 51 is positioned between the oil pump 4 and the support frame 6 to protect the oil pump 4 from being interfered with by the support frame 6 due to axial displacement of the drive shaft 5 caused by the clearance between the drive shaft 5 and the oil pump 4.

The and of the drive shaft 5 forms a rectangular fitting portion 52, which is fit into the drive gear 7, and is further coupled to a shaft 401 of the cooling water pump 40 to operatively connect the water pump 40 to the oil pump 4. The support frame 6 is a semi-circular member defining a bore 61 at a center of the circular configuration of the support frame 6. The bore 61 receives the extension of the drive shaft 5. The bore 61 is supported by a web 62 connecting to a flange 63. The flange 61 defines securing holes 631 for receiving the threaded fasteners S1 to secure the support frame 6 to the crankshaft case 91 so as to stably position the support frame 6.

The drive gear 7 defines a central bore 71 that is configured corresponding to the fitting portion 52 of the drive shaft 5 so that when the drive gear 7 is driven by the drive chain 92, the drive shaft 5 is synchronously driven to rotate.

The oil collector lid 8 has a configuration corresponding to the support frame 6, and also forms a plurality of securing holes 81 which the threaded fastener S1 extend to secure both the oil collector lid 8 and the support frame 6 to the crankshaft case 91. The oil collector lid 8 has an inclined section extending from the securing holes 81 in radial and inward direction so as to define an oil collection space inside the oil collector lid 8. The space serves not only to contain oil therein, but also accommodate portions of the drive gear 7 and the drive chain 92 to ensure the drive gear 7 and the drive chain 92 to be properly lubricated during the operation thereof.

Also referring to FIG. 4, when the engine is in operation, the crankshaft 9 is driven to rotate, which rotation is transmitted through the transmission gear 93 mounted to the crankshaft 9 and the drive chain 92 coupled to the drive gear 7 of the drive shaft 5 to the drive shaft 5. The shaft 5 then drives the operation of the oil pump 4. With the oil pump 4, oil that is contained in an oil chamber (not shown) can be pumped through parts of the engine to lubricate the parts of the engine. Meanwhile, the water pump 40 is also driven to pump cooling water for cooling the engine.

The feature of the present invention is the support frame 6 arranged between the oil pup 4 and the fitting portion 52, which provides an additional support point to the drive shaft 5 in addition to the support provided by the oil pump 4 that physically engages the drive shaft 5. Thus, the drive shaft 5 is supported at two spaced location, which effectively increases structural strength of the drive shaft 5, and also enhances rotational rigidity of the shaft 5. Thus, influence induced on the drive shaft 5 by the vacation of rotational speed of the engine is reduced and vibration caused thereby is alleviated and even eliminated. In other words, stability of the drive shaft 5 is enhanced and oscillation of the shaft 5 is reduced, which apparently leads to stable coupling with the drive chain 92 and thus reduces noise. Service life of the drive shaft 5 is thus extended.

Although the present invention has been described with reference to what is believed to be the preferred embodiments of the present invention, it is apparent to those skilled in the art that a variety of modifications and changes may be made without departing from the scope of the present invention which is intended to be defined by the appended claims It will be understood that each of the element described above, or two or more together may also find a useful application in other types of methods differing from the type described above.

While certain novel features of this invention have been shown and described and are pointed out in annexed claim, it is intended to be limited to the details above, since it will be understood that various omissions, modifications, substitutions and changes in forms and details of the device illustrated and in its operation can be made by those skilled in the art without departing in any way from the spirit of the invention.

We claim:

1. In a motorcycle having an oil pump system, said oil pump system including an oil pump, a cooling water pump, a drive shaft, a drive gear and an oil collector lid, said oil pump being fixed to a crankshaft case and rotatably supported for continuous rotation to pump oil, said oil pump having first securing holes that receive first fasteners to secure oil pump to said crankshaft case, said oil pump being coupled to said drive shaft for being driven by said drive shaft for pumping operation, said drive shaft having an opposite end extending in a direction away from said oil pump, said drive shaft having an end formed with a rectangular fitting portion fitted into said drive gear and further coupled to a shaft of said cooling water pump to operatively connect said cooling water pump to said oil pump, said drive gear having a central bore configured to engage with said fitting portion of said drive shaft, the improvement wherein a stop ring, a support frame, said drive gear and said oil collector lid are mounted in sequence to an opposite end section of said drive shaft, said stop ring being positioned between said oil pump and said support frame to protect said oil pump from being interfered with by said support frame due to axial displacement for said drive shaft caused by clearance between said drive shaft and said oil pump, said support frame having a center provided with a bore which receives an extension of said drive shaft, said bore being supported by a web connecting a flange which defines second securing holes for receiving second fasteners to secure said support frame to said crankshaft case, said support frame being a semi-circular member, and said oil collector lid having a configuration corresponding to said support frame and having third securing holes through which said second fasteners extend to secure both said oil collector lid and said support frame to said crankshaft case.

* * * * *